US006951415B2

(12) United States Patent
Amano et al.

(10) Patent No.: US 6,951,415 B2
(45) Date of Patent: Oct. 4, 2005

(54) VEHICLE LAMP

(75) Inventors: Yasuyuki Amano, Shizuoka (JP); Hiroya Koizumi, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 107 days.

(21) Appl. No.: 10/611,102

(22) Filed: Jul. 2, 2003

(65) Prior Publication Data

US 2004/0027833 A1 Feb. 12, 2004

(30) Foreign Application Priority Data

Jul. 4, 2002 (JP) ..... P. 2002-196594
Jun. 5, 2003 (JP) ..... P. 2003-160330

(51) Int. Cl.[7] ..... F21V 5/00

(52) U.S. Cl. ..... 362/520; 362/518; 362/328; 362/297

(58) Field of Search ..... 362/31, 307, 326–328, 362/518, 297, 520; 359/726

(56) References Cited

U.S. PATENT DOCUMENTS

| | | | | | |
|---|---|---|---|---|---|
| 5,197,792 | A | * | 3/1993 | Jiao et al. | 362/31 |
| 5,453,855 | A | | 9/1995 | Nakamura et al. | |
| 6,097,549 | A | * | 8/2000 | Jenkins et al. | 359/726 |
| 6,200,006 | B1 | * | 3/2001 | Natsume et al. | 362/297 |
| 6,598,998 | B2 | * | 7/2003 | West et al. | 362/307 |
| 6,811,277 | B2 | * | 11/2004 | Amano | 362/31 |

FOREIGN PATENT DOCUMENTS

| | | | |
|---|---|---|---|
| DE | 196 38 081 | A1 | 3/1998 |
| DE | 20206829 | U1 | 9/2002 |
| EP | 0 354 961 | A1 | 2/1990 |
| EP | 1 255 306 | A2 | 11/2002 |
| JP | 61-153201 | U | 9/1986 |
| JP | 11-265606 | A | 9/1999 |
| JP | 2003-77314 | A | 3/2003 |
| WO | WO02/076788 | A1 | 10/2002 |

* cited by examiner

*Primary Examiner*—Ali Alavi
(74) *Attorney, Agent, or Firm*—Sughrue Mion, PLLC

(57) ABSTRACT

Light from an LED light source, which is placed to be directed toward the front of a lamp, is incident on a translucent member, and the light that is transmitted through the translucent member is reflected by a reflector toward the front of the lamp. An internal reflection portion that internally reflects light which is incident on the translucent member at a small angle with respect to an optical axis of the LED light source, in a direction which is substantially perpendicular to the optical axis, and a refraction portion that refracts light which is incident at a large angle with respect to the optical axis, in a direction which is substantially perpendicular to the optical axis, are formed on the surface of the translucent member. The LED emitted light can be caused to be incident on a reflective surface of the reflector in the form of substantially parallel beams which are directed in a direction that is substantially perpendicular to the optical axis. The LED emitted light can be caused to be incident on the range extending even to the peripheral edge of the reflective surface, without increasing the depth of the reflector. The reflection due to the reflector can be easily controlled.

12 Claims, 16 Drawing Sheets

VEHICLE LAMP

BACKGROUND OF THE INVENTION

1. Field of the Invention

The present invention relates to a vehicle lamp comprising an LED (Light Emitting Diode) light source. More particularly, the present invention related to a vehicle lamp which comprises an LED light source in which a whole reflective surface of a reflector of the lamp can be seen glaring while the reflector size is reduced.

2. Description of the Related Art

Recently, vehicle lamps comprising an LED light source have been widely used. JP-UM-A-61-153201 discloses a vehicle lamp which is configured in the following manner. Light emitted from an LED light source, which is placed to be directed toward the front of the lamp, is incident on a translucent member. The light from the LED light source that is transmitted through the translucent member is reflected toward the front of the lamp by a reflector which is formed integrally with the translucent member.

When a lamp is configured as described above, the light from the LED light source can be used in the form of reflected light from the reflector.

In the vehicle lamp disclosed in the publication, the direction of the light incident on a reflective surface of the reflector is varied depending on portions of the reflective surface. Consequently, there arise problems in that it is difficult to form the reflective surface so that, when the reflector is observed from the front side of the lamp, the whole reflective surface is seen glaring, and also that, in order to realize such formation, the reflector must be large in depth to some extent.

The invention has been conducted in view of such circumstances. It is an object of the invention to provide a vehicle lamp which comprises an LED light source, and in which a whole reflective surface of a reflector can be seen glaring while the reflector size is reduced.

SUMMARY OF THE INVENTION

In the invention, a translucent member is formed so as to have a unique shape to attain the above objects.

The vehicle lamp of the invention comprises: a light source, and preferably an LED light source which is placed to be directed toward a front of the lamp; a translucent member which is placed to receive light from the LED light source; and a reflector which is placed to reflect the light from the LED light source that is transmitted through the translucent member, toward the front of the lamp, wherein an internal reflection portion and a refraction portion are formed on a surface of the translucent member, the internal reflection portion internally reflecting small-angle incident light in a direction which is substantially perpendicular to an optical axis of the LED light source, the small-angle incident light being incident on the translucent member at a small angle with respect to the optical axis, the refraction portion retracting large-angle incident light in a direction which is substantially perpendicular to the optical axis, the large-angle incident light being incident on the translucent member at a large angle with respect to the optical axis.

The kind of vehicle lamp is not restricted to particular kinds of vehicle lamps, and may be employed as a tail lamp, a stop lamp, or the like.

The material of translucent member is not particularly restricted as long as the member is translucent. For example, a member made of a transparent synthetic resin or glass may be used as the translucent member. Also specific shapes of the internal reflection portion and the refraction portion of the translucent member are not particularly restricted.

For the reflector, the specific shape of the reflective surface and the like are not particularly restricted as far as the light from the LED light source that is transmitted through the translucent member can be reflected toward the front of the lamp. Moreover, the reflector may be a usual reflector which is configured so as to reflect the light from the LED light source by the outer surface, or a reflector which is made of a transparent member so as to internally reflect the light from the LED light source that is transmitted through the reflector. In the latter case, the reflector may be configured separately from the translucent member, or a part of the reflector may be configured integrally with the translucent member.

As described above, the vehicle lamp of the invention is configured so that the light from the LED light source which is placed to be directed toward the front of the lamp is incident on the translucent member, and the light from the LED light source that is transmitted through the translucent member is reflected by the reflector toward the front of the lamp. The internal reflection portion that internally reflects small-angle incident light which is incident on the translucent member at a small angle with respect to the optical axis of the LED light source, in a direction which is substantially perpendicular to the optical axis, and the refraction portion that refracts a large-angle incident light which is incident on the translucent member at a large angle with respect to the optical axis, in a direction which is substantially perpendicular to the optical axis are formed on the surface of the translucent member. Therefore, the light from the LED light source can be caused to be incident on the reflective surface of the reflector in the form of substantially parallel beams which are directed in a direction that is substantially perpendicular to the optical axis.

Consequently, the light from the LED light source can be caused to be incident on the range extending even to the peripheral edge of the reflective surface, without increasing the depth of the reflector. Since the light from the LED light source is incident in the form of substantially parallel beams on the reflective surface of the reflector, the reflection due to the reflector can be easily controlled.

According to the invention, in the vehicle lamp comprising the LED light source, therefore, the whole reflective surface can be seen glaring while the reflector size can be reduced.

In the above configuration, the internal reflection portion of the translucent member may be configured by a generally funnel-like curved surface of revolution about the optical axis, and the refraction portion of the translucent member may be configured by a generally annular dome-like curved surface of revolution about the optical axis. According to the configuration, it is possible to attain the following functions and effects.

Namely, the light from the LED light source can be caused to be incident on the reflective surface of the reflector over the whole periphery of the optical axis, in the form of substantially parallel beams which are directed in a direction that is substantially perpendicular to the optical axis. Therefore, a large light emission area can be ensured by the single LED light source. Moreover, the LED light source can be placed at the center of the lamp, and hence the external shape of the lamp can be freely set.

In the above configuration, the reflective surface of the reflector may be configured by a plurality of reflective elements which reflect the light from the LED light source that is transmitted through the translucent member, toward the front of the lamp, and the reflective elements may be placed in a stepwise manner via stepped portions elongating in a direction which is substantially perpendicular to the optical axis. According to the configuration, the lamp can be further thinned (i.e., its size reduced), and the whole reflective surface of the reflector can be seen glaring in an approximately uniformly scattered manner. Each of reflective elements may have a surface configuration which simply reflects the light from the LED light source so as to be deflected toward the front of the lamp, or that which reflects the light from the LED light source so as to be deflected toward the front of the lamp and diffused.

In the above configuration, at least part of the reflective surface of the reflector may be configured to reflect the light from the LED light source that is transmitted through the translucent member, toward the front of the lamp by internal reflection. In this case, the size of the lamp can be further reduced by a degree corresponding to the thickness of the reflector.

The vehicle lamp of the invention may comprise only one set of the LED light source, the translucent member, and the reflector. Alternatively, the vehicle lamp may comprise a plurality of sets of the LED light source, the translucent member, and the reflector. In the latter case, the brightness of the vehicle lamp can be further enhanced. In the invention, the external shape of the lamp can be freely set. In this case, therefore, the sets of the LED light source, the translucent member, and the reflector can be freely arranged in accordance with the shape of the lamp or the like.

DETAILED DESCRIPTION OF THE INVENTION

Hereinafter, an embodiment of the invention will be described with reference to the accompanying drawings.

Figure 1:
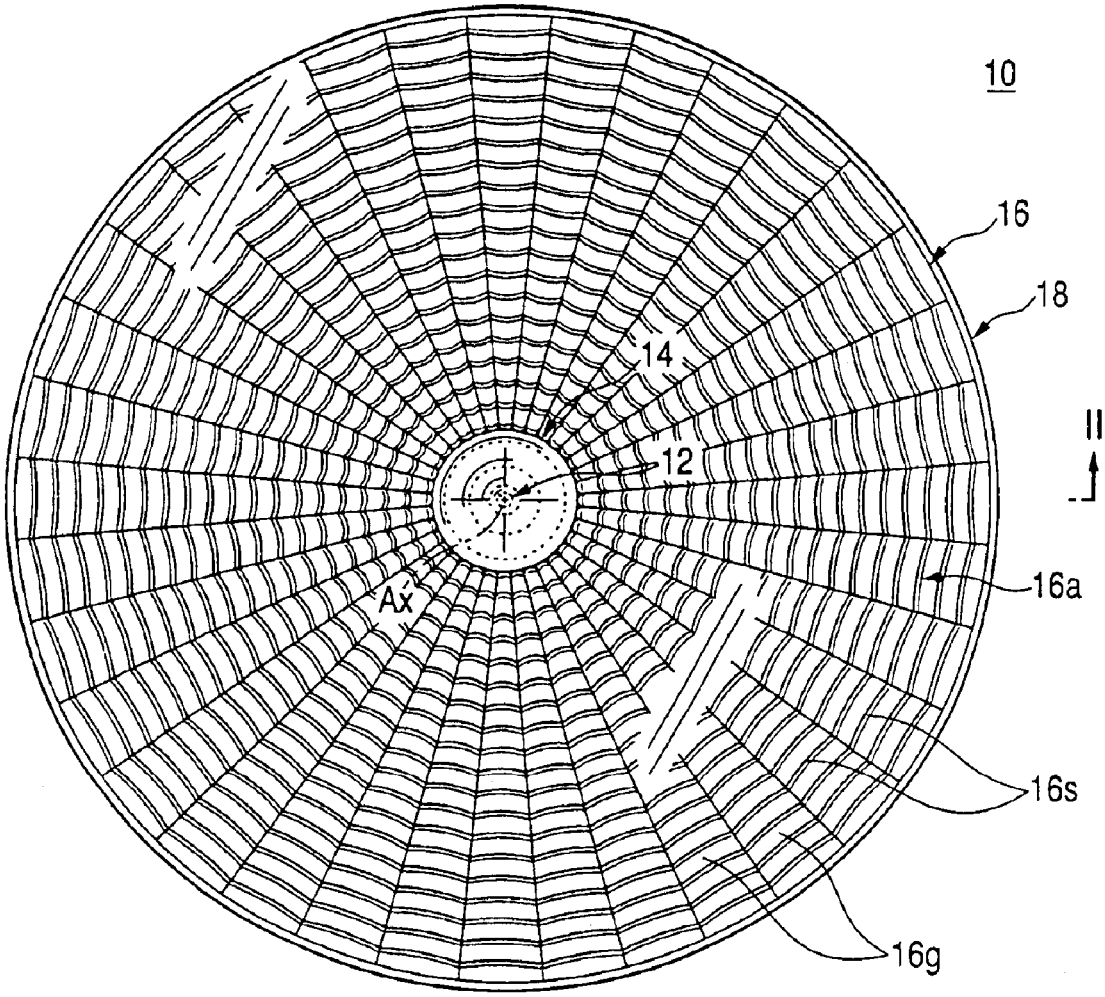
FIG. 1 is a front view showing a vehicle lamp of an embodiment of the invention.
Figure 2:
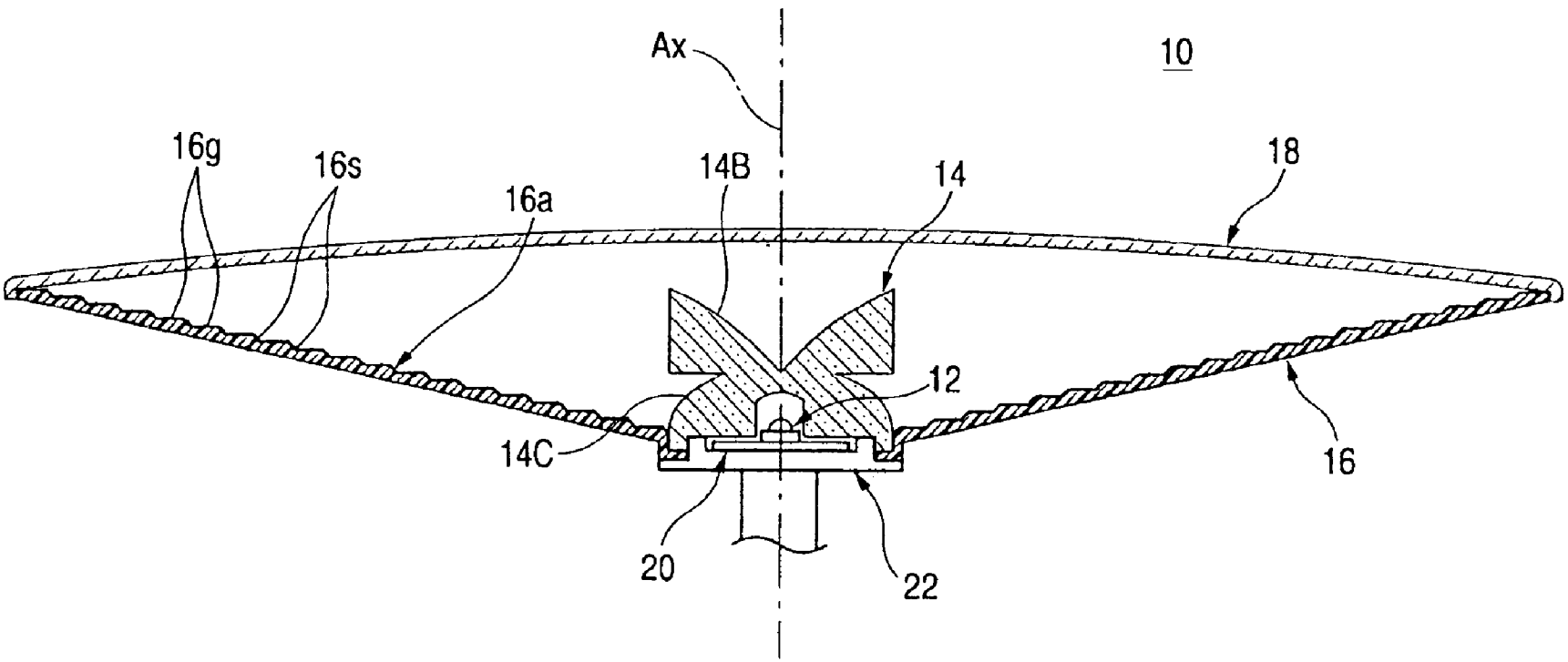
FIG. 2 is a section view taken along line II—II of FIG. 1.
Figure 3:
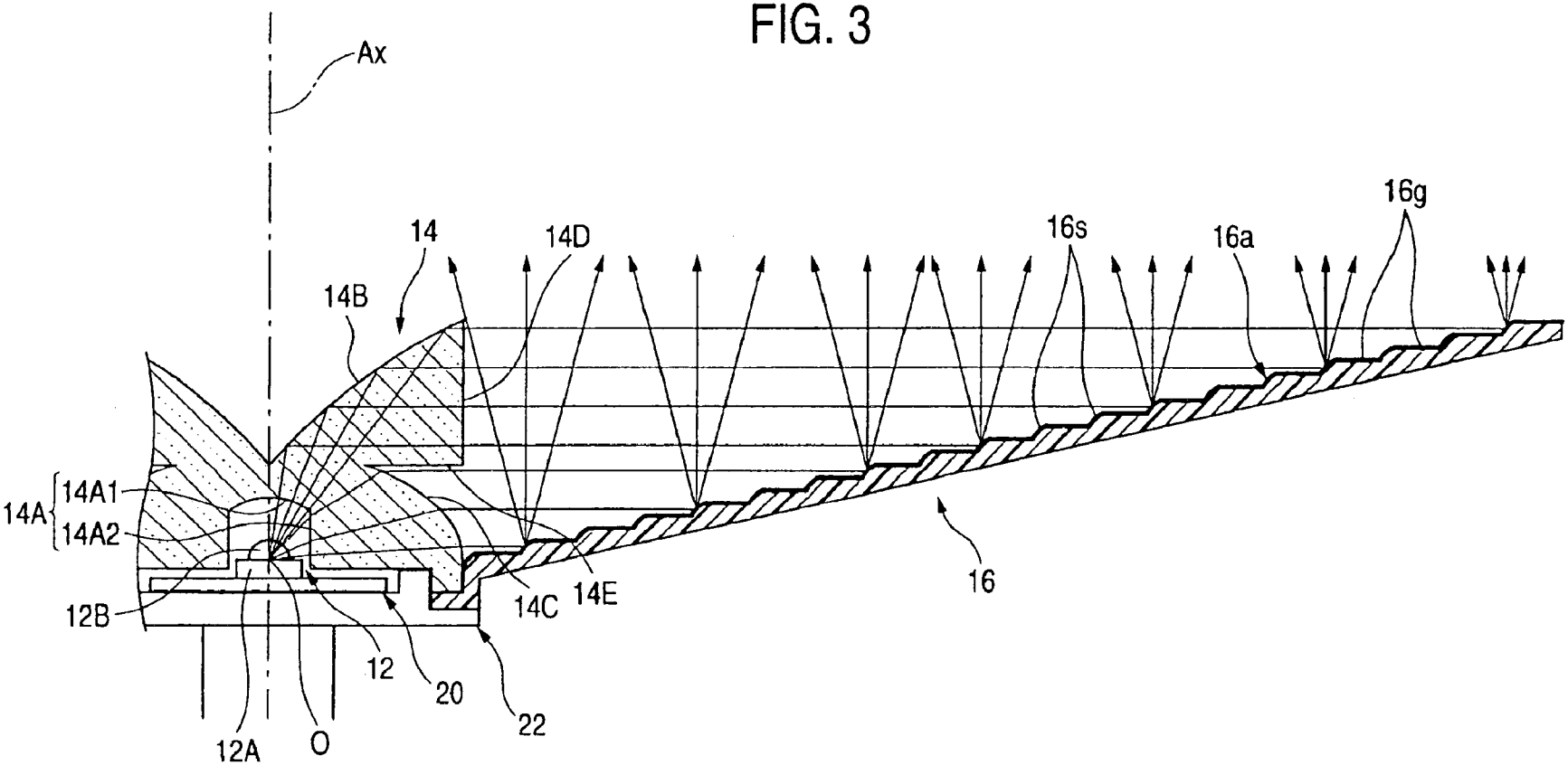
FIG. 3 is a detail view of main portions of FIG. 2.

FIG. 1 is a front view showing a vehicle lamp of the embodiment, FIG. 2 is a section view taken along line II—II of FIG. 1, and FIG. 3 is a detail view of main portions of FIG. 2.

As shown in the figures, the vehicle lamp 10 of the embodiment is a tail lamp which is to be mounted on a rear end of a vehicle, and comprises an LED light source 12, a translucent member 14, a reflector 16, and a translucent cover 18.

The LED light source 12 is placed to be directed toward the front of the lamp ("rear side" of the vehicle, the same shall apply hereinafter) so that the optical axis Ax coincides with the center axis of the lamp which elongates in the longitudinal direction of the vehicle. The LED light source 12 consists of an LED main unit (LED chip) 12A, and a sealing resin 12B which covers the luminescence center O of the LED main unit 12A in a hemispherical manner. The LED light source is fixed to a substrate support member 22 via a substrate 20.

The translucent member 14 is configured by a transparent synthetic resin molded piece which is placed so as to cover the LED light source 12 from the front side, and a rear face portion of the member is fixed to the substrate support member 22.

A light-incidence recess 14A on which light from the LED light source 12 (hereinafter, often referred to as "LED emitted light") is to be incident is formed in the rear face portion of the translucent member 14. The light-incidence recess 14A is configured by a spherical portion 14A1 which spherically surrounds the luminescence center O, and a cylindrical portion 14A2 which cylindrically surrounds the optical axis Ax. In the LED emitted light, light which is emitted at a small angle (specifically, an angle of, for example, about 40 deg. or smaller) with respect to the optical axis Ax is incident perpendicularly on the spherical portion 14A1, and then straightly advances through the translucent member 14. By contrast, light which is emitted at a large angle (specifically, an angle which is larger than, for example, about 40 deg.) with respect to the optical axis Ax is incident obliquely on the cylindrical portion 14A2, and then advances through the translucent member 14 being refracted toward the outer periphery of the translucent member 14.

An internal reflection portion 14B and a refraction portion 14C are formed on the surface of the translucent member 14. The internal reflection portion internally reflects the small-angle incident light (the light incident on the spherical portion 14A1) which is incident on the translucent member 14 at a small angle with respect to the optical axis Ax, in a direction which is substantially perpendicular to the optical axis Ax. The refraction portion refracts the large-angle incident light (the light incident on the cylindrical portion 14A2) which is incident on the translucent member 14 at a large angle with respect to the optical axis Ax, in a direction which is substantially perpendicular to the optical axis Ax.

The internal reflection portion 14B is configured by a generally funnel-like curved surface of revolution about the optical axis Ax, in the front face of the translucent member 14. On the other hand, the refraction portion 14C is configured by a generally annular dome-like curved surface of revolution about the optical axis Ax, on the rear side of the internal reflection portion 14B.

The portion of the surface of the translucent member 14 which is on the side of the outer periphery of the internal reflection portion 14B is formed as a cylindrical outer peripheral portion 14D which is configured by a cylindrical face centered at the optical axis Ax. According to the configuration, the LED emitted light which is internally reflected by the internal reflection portion 14B to be directed in a direction that is substantially perpendicular to the optical axis Ax is caused to straightly advance through the cylindrical outer peripheral portion 14D to the outside of the translucent member 14. A rear end portion of the cylindrical outer peripheral portion 14D is formed as an annular flat portion 14E configured by a plane which is perpendicular to the optical axis Ax, so that the LED emitted light which is internally reflected by the internal reflection portion 14B, and that which is refracted by the refraction portion 14C are not blocked by the annular flat portion 14E.

The reflector 16 is placed so as to reflect the LED emitted light which is transmitted through the translucent member 14, toward the front of the lamp. The reflector 16 is configured by applying a reflective surface treatment on the front face of a synthetic resin molded piece which is formed into a flat conical shape, and has a circular external shape in the front view of the lamp.

A reflective surface 16*a* of the reflector 16 is configured by a plurality of reflective elements 16*s* which reflect the LED emitted light that is transmitted through the translucent member 14, toward the front of the lamp. The reflective elements 16*s* are arranged so as to partition the reflective surface 16*a* radially and concentrically. With respect to a radial direction, the reflective elements 16*s* are placed at regular intervals in a stepwise manner via stepped portions 16*g* elongating along a plane which is substantially perpendicular to the optical axis Each of the reflective elements 16*s* is formed into a convex curved surface in which a conical surface having a center axis coinciding with the optical axis Ax, and an apex angle of 90 deg. is used as a reference plane, and which has a predetermined curvature in both radial and circumferential directions with respect to the optical axis Ax. Therefore, the reflective elements diffusively reflect the LED emitted light from the translucent member 14 in both radial and circumferential directions with respect to the optical axis Ax.

The translucent cover 18 is a plain cover which is configured by a transparent synthetic resin molded piece, and has a circular external shape in the front view of the lamp. An outer peripheral edge of the translucent cover 18 is fixed to the reflector 16.

Figure 4:
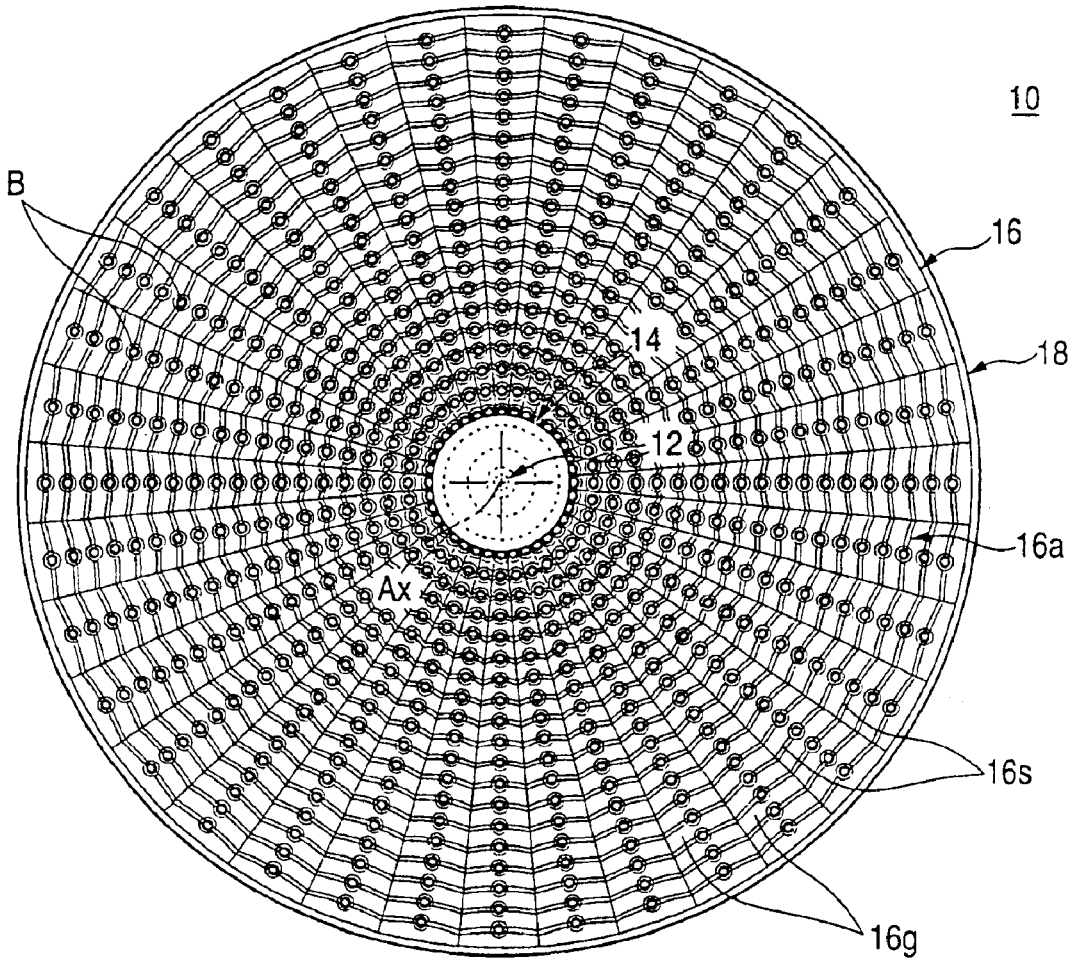
FIG. 4 is a front view showing the vehicle lamp in a light-on state.

FIG. 4 is a front view showing the vehicle lamp 10 of the embodiment in a state where the LED light source 12 is lit up.

As shown in the figure, when the vehicle lamp 10 is observed from the front side, the plural reflective elements 16*s* constituting the reflective surface 16*a* of the reflector 16 are seen simultaneously glaring in a scattered manner. At this time, center portions of the reflective elements 16*s* can be seen glaring as brilliant portions B because, as described above, each of the reflective elements 16*s* is formed into a convex curved surface in which a conical surface having a center axis coinciding with the optical axis Ax, and an apex angle of 90 deg. is used as a reference plane, and the LED emitted light is incident on the reflective elements in the form of substantially parallel beams.

Even when the visual point is somewhat deviated from the front direction of the lamp, in each of the reflective elements 16*s*, a portion which is shifted from the center portion by a degree corresponding to the movement amount of the visual point is seen glaring as a brilliant portion B because the LED emitted light is incident on the reflective elements 16*s* in the form of substantially parallel beams.

As described above in detail, the vehicle lamp 10 of the embodiment is configured so that the light from the LED light source 12 which is placed to be directed toward the front of the lamp is incident on the translucent member 14, and the LED emitted light that is transmitted through the translucent member 14 is reflected by the reflector 16 toward the front of the lamp. The internal reflection portion 14B that internally reflects the small-angle incident light which is incident on the translucent member 14 at a small angle with respect to the optical axis Ax of the LED light source 12, in a direction which is substantially perpendicular to the optical axis Ax, and the refraction portion 14C that refracts the large-angle incident light which is incident on the translucent member 14 at a large angle with respect to the optical axis Ax, in a direction which is substantially perpendicular to the optical axis Ax are formed on the surface of the translucent member 14. Therefore, the LED emitted light can be caused to be incident on the reflective surface 16*a* of the reflector 16 in the form of substantially parallel beams which are directed in a direction that is substantially perpendicular to the optical axis Ax.

Consequently, the LED emitted light can be caused to be incident on the range extending even to the peripheral edge of the reflective surface 16*a*, without increasing the depth of the reflector 16. Since the LED emitted light is incident in the form of substantially parallel beams on the reflective surface 16*a* of the reflector 16, the reflection due to the reflector 16 can be easily controlled.

According to the embodiment, therefore, the whole reflective surface 16*a* can be seen glaring while the reflector 16 can be made thinner or smaller in size.

In the embodiment, particularly, the internal reflection portion 14B of the translucent member 14 is configured by the generally funnel-like curved surface of revolution about the optical axis Ax, and the refraction portion 14C of the translucent member 14 is configured by the generally annular dome-like curved surface of revolution about the optical axis Ax. Therefore, it is possible to attain the following functions and effects.

The LED emitted light can be caused to be incident on the reflective surface 16*a* of the reflector 16 over the whole periphery of the optical axis Ax, in the form of substantially parallel beams which are directed in a direction that is substantially perpendicular to the optical axis Ax. Therefore, a large light emission area can be ensured by the single LED light source 12. Moreover, the LED light source 12 can be placed at the center of the lamp, and hence the external shape of the lamp can be freely set.

In the embodiment, the reflective surface 16*a* of the reflector 16 is configured by the plural reflective elements 16*s* which reflect the LED emitted light that is transmitted through the translucent member 14, toward the front of the lamp, and the reflective elements 16*s* are placed in a stepwise manner via the stepped portions 16*g* elongating in a direction which is substantially perpendicular to the optical axis Ax. Therefore, the lamp can be further thinned, and the whole reflective surface 16*a* of the reflector 16 can be seen glaring in an approximately uniformly scattered manner.

In the embodiment, each of the reflective elements 16*s* has a surface configuration which diffusively reflects the LED emitted light from the translucent member 14 in both radial and circumferential directions with respect to the optical axis Ax. Alternatively, each of the reflective elements 16*s* may have a surface configuration which simply reflects the LED emitted light from the translucent member 14 so as to be deflected toward the front of the lamp, and the translucent cover 18 or the like may be provided with a diffusing function.

Next, a first modification of the embodiment will be described.

Figure 5:
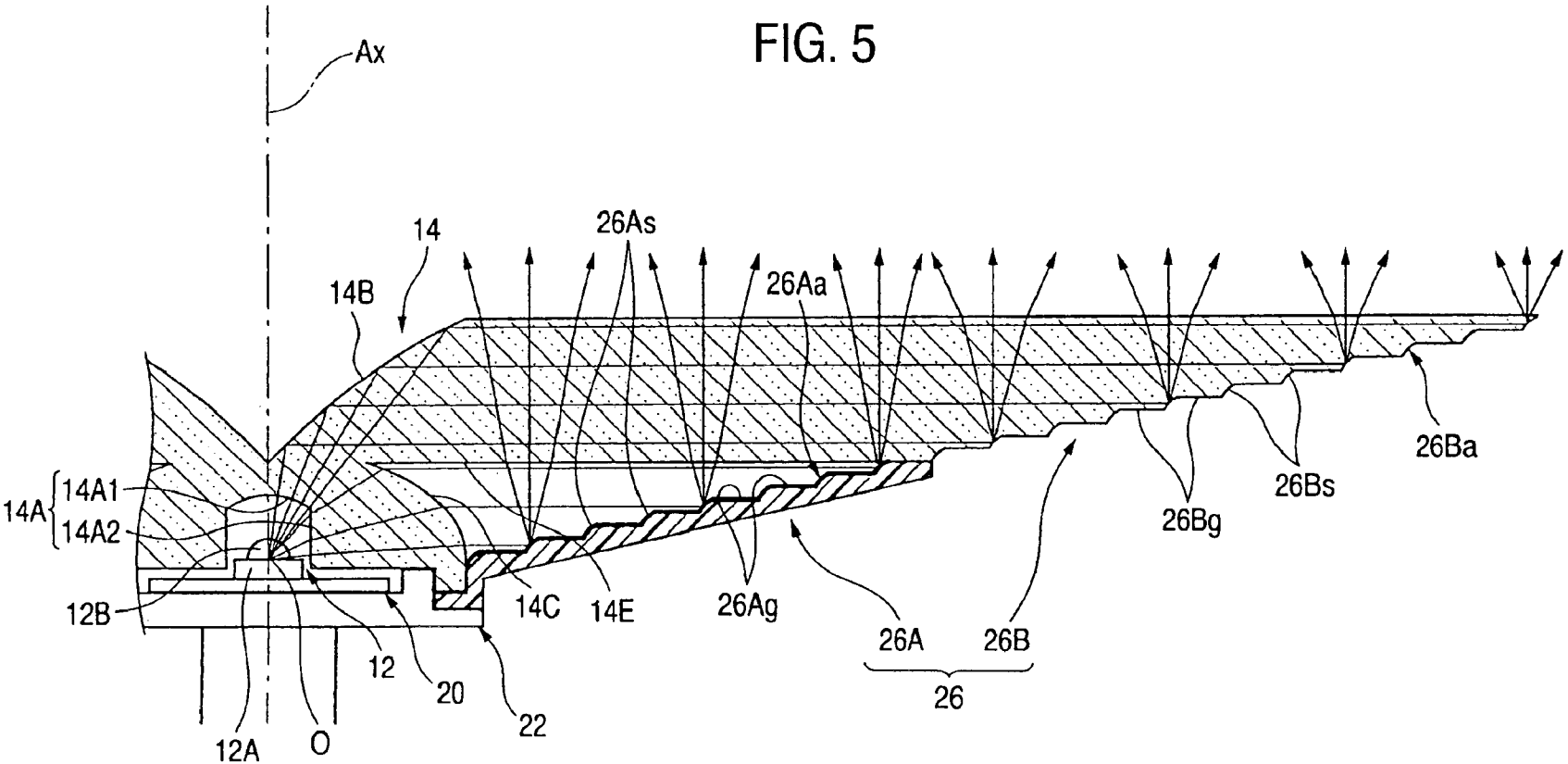
FIG. 5 is a view similar to FIG. 3 showing a reflector in a first modification of the embodiment.

FIG. 5 is a view similar to FIG. 3 showing a reflector 26 in the modification.

As shown in the figure, in the reflector 26, an inner peripheral portion on which the LED emitted light from the refraction portion 14C of the translucent member 14 is incident is configured as an ordinary reflector portion 26A, and an outer peripheral portion on which the LED emitted light from the internal reflection portion 14B of the translucent member 14 is incident is configured as an internal reflection reflector portion 26B.

The ordinary reflector portion 26A has the same configuration as that of the inner peripheral portion of the reflector 16 in the embodiment. Namely, a reflective surface 26Aa of the reflector 26 is configured by a plurality of reflective elements 26As which are placed at regular intervals in a stepwise manner via stepped portions 26Ag.

By contrast, the internal reflection reflector portion 26B is configured to internally reflect the LED emitted light that is transmitted through the translucent member 14, toward the front of the lamp by internal reflection. Specifically, the internal reflection reflector portion 26B is formed integrally with the translucent member 14 by extending the translucent member 14 from the cylindrical outer peripheral portion 14D (see FIG. 3) in the outer peripheral direction. A reflective surface 26Ba is formed on the outer peripheral end face of the reflector portion. The reflective surface 26Ba is configured by a plurality of reflective elements 26Bs which are placed at regular intervals in a stepwise manner via stepped portions 26Bg.

Also when the configuration of the modification is employed, in the same manner as the embodiment, the whole reflective surfaces 26Aa and 26Ba can be seen glaring while the reflector 26 can be thinned.

When the configuration of the modification is employed, moreover, the internal reflection reflector portion 26B is thinner than the outer peripheral portion of the reflector 16 in the embodiment on which the LED emitted light from the internal reflection portion 14B of the translucent member 14 is incident, by a degree corresponding to the thickness of the reflector 16. Therefore, the lamp can be compactly configured.

In the modification, the internal reflection reflector portion 26B is configured by the transparent member. Therefore, a sense of transparency (sometimes known as a sense of crystal) can be produced particularly in the appearance when the LED light source 12 is turned off.

Next, a second modification of the embodiment will be described.

Figure 6:
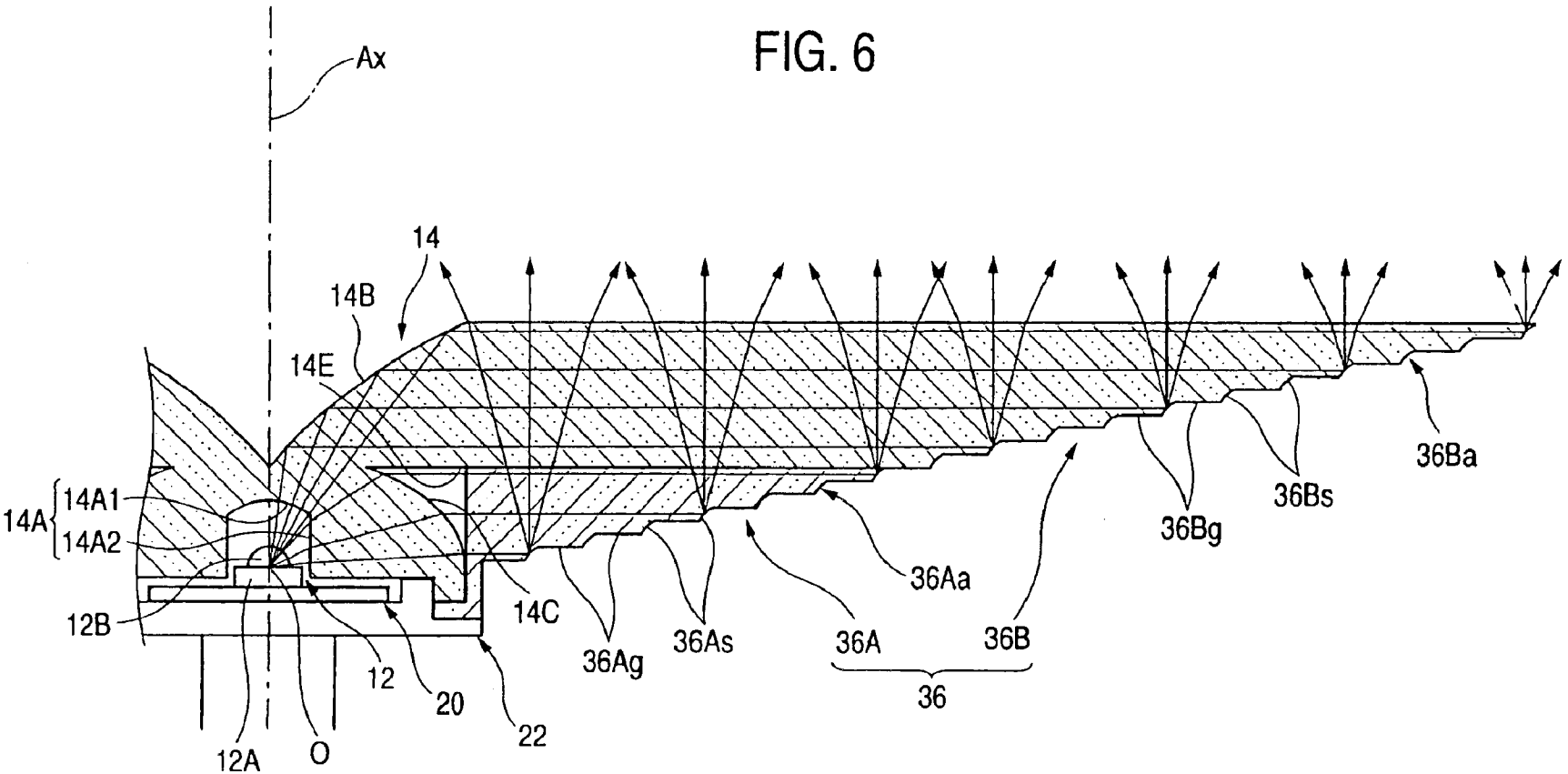
FIG. 6 is a view similar to FIG. 3 showing a reflector in a second modification of the embodiment.

FIG. 6 is a view similar to FIG. 3 showing a reflector 36 in the modification.

As shown in the figure, in the reflector 36, an outer peripheral portion on which the LED emitted light from the internal reflection portion 14B of the translucent member 14 is incident is configured as an internal reflection reflector portion 36B which is similar to the internal reflection reflector portion 26B of the reflector 26 in the first modification. Namely, a reflective surface 36Ba of the internal reflection reflector portion 36B is configured by a plurality of reflective elements 36Bs which are placed at regular intervals in a stepwise manner via stepped portions 36Bg.

By contrast, in the reflector 36 in the modification, an inner peripheral portion on which the LED emitted light from the refraction portion 14C of the translucent member 14 is incident is configured as an internal reflection reflector portion 36A. The internal reflection reflector portion 36A is configured by a transparent synthetic resin molded piece which is different from the translucent member 14. A reflective surface 36Aa of the reflector portion is configured by a plurality of reflective elements 36As which are placed at regular intervals in a stepwise manner via stepped portions 36Ag.

Also when the configuration of the modification is employed, in the same manner as the embodiment, the whole reflective surfaces 36Aa and 36Ba can be seen glaring while the reflector 36 can be thinned.

When the configuration of the modification is employed, moreover, the reflector 36 is thinner than the reflector 16 in the embodiment by a degree corresponding to the thickness of the reflector 16. Therefore, the lamp can be more compactly configured.

In the modification, the whole reflector 36 is configured by the transparent member. Therefore, a higher sense of transparency (a sense of crystal) can be produced particularly in the appearance when the LED light source 12 is turned off.

Next, a third modification of the embodiment will be described.

Figure 7:
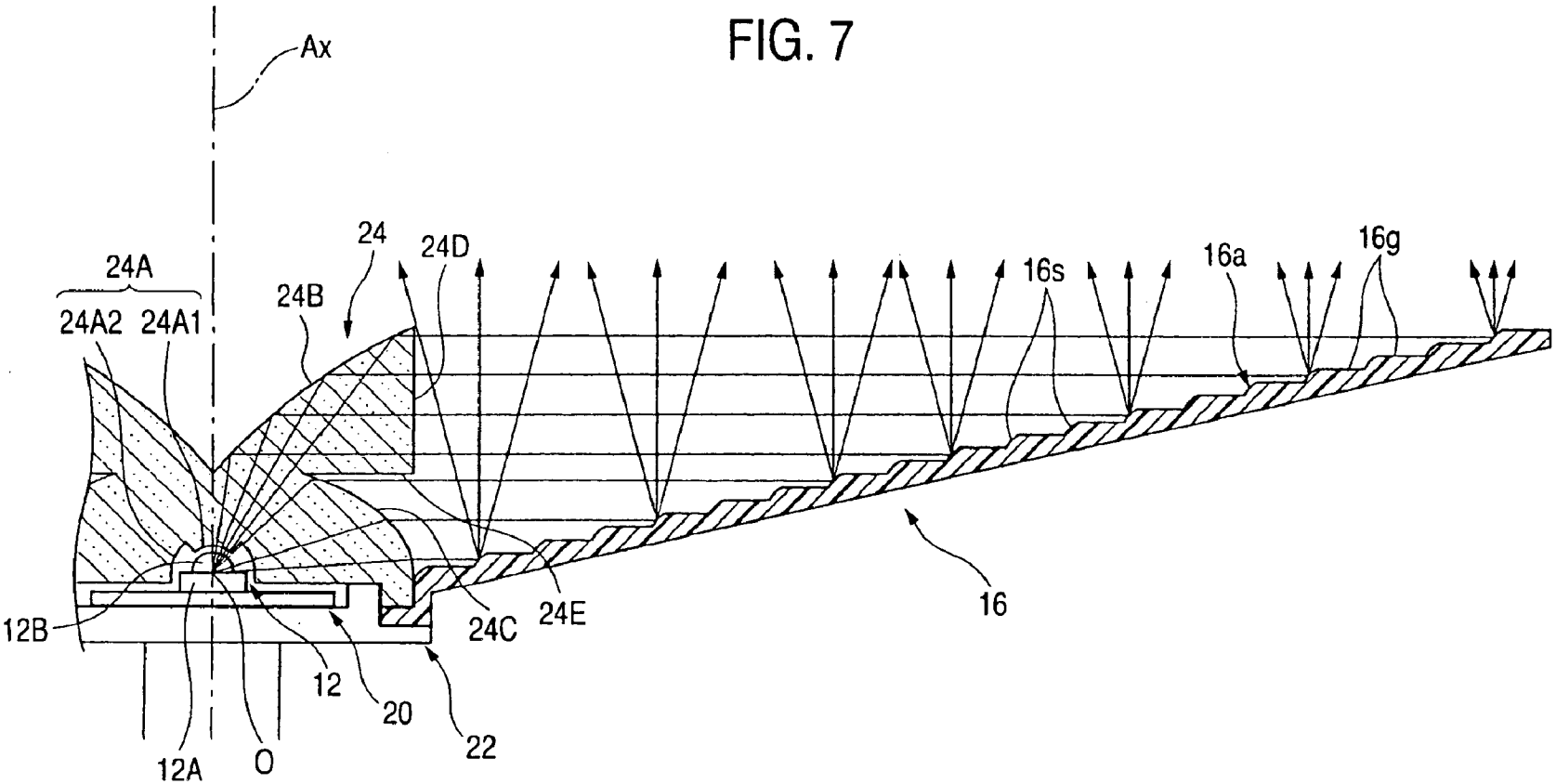
FIG. 7 is a view similar to FIG. 3 showing a translucent member in a third modification of the embodiment.

FIG. 7 is a view similar to FIG. 3 showing a translucent member 24 in the modification.

As shown in the figure, in the translucent member 24, a light-incidence recess 24A is configured in a manner different from the light-incidence recess 14A of the translucent member 14 in the FIG. 3 embodiment.

The light-incidence recess 24A of the translucent member 24 is configured by a first spherical portion 24A1 which spherically surrounds the luminescence center O in a position close to the sealing resin 12B of the LED light source 12, and a second spherical portion 24A2 which is in the periphery of the first spherical portion 24A1, and which spherically surrounds the luminescence center O by a radius that is larger than that of the first spherical portion 24A1. In the LED emitted light, light which is emitted at a small angle with respect to the optical axis Ax is incident perpendicularly on the first spherical portion 24A1, and then straightly advances through the translucent member 24. Also light which is emitted at a large angle with respect to the optical axis Ax is incident perpendicularly on the second spherical portion 24A2, and then straightly advances through the translucent member 24.

In the same manner as the embodiment, an internal reflection portion 24B, a refraction portion 24C, a cylindrical outer peripheral portion 24D, and an annular flat portion 24E are formed on the surface of the translucent member 24. Among the portions, the internal reflection portion 24B, the cylindrical outer peripheral portion 24D, and the annular flat portion 24E are configured in strictly the same manner as those in the embodiment. By contrast, the refraction portion 24C is formed so that the front end is positioned closer to the optical axis Ax than that of the refraction portion 14C in the embodiment, in order to cause the LED emitted light which advances through the translucent member 24 straightly and radially from the luminescence center O, to be refracted in a direction which is substantially perpendicular to the optical axis Ax.

Also when the configuration of the modification is employed, in the same manner as the embodiment, the LED emitted light can be caused to be incident on the reflective surface 16*a* of the reflector 16 in the form of substantially parallel beams which are directed in a direction that is substantially perpendicular to the optical axis Ax.

When the configuration of the modification is employed, moreover, the LED emitted light advances through the translucent member 24 straightly and radially, and hence the optical computation for setting the curved shape of the refraction portion 24C can be easily conducted.

Next, a fourth modification of the embodiment will be described.

Figure 8:
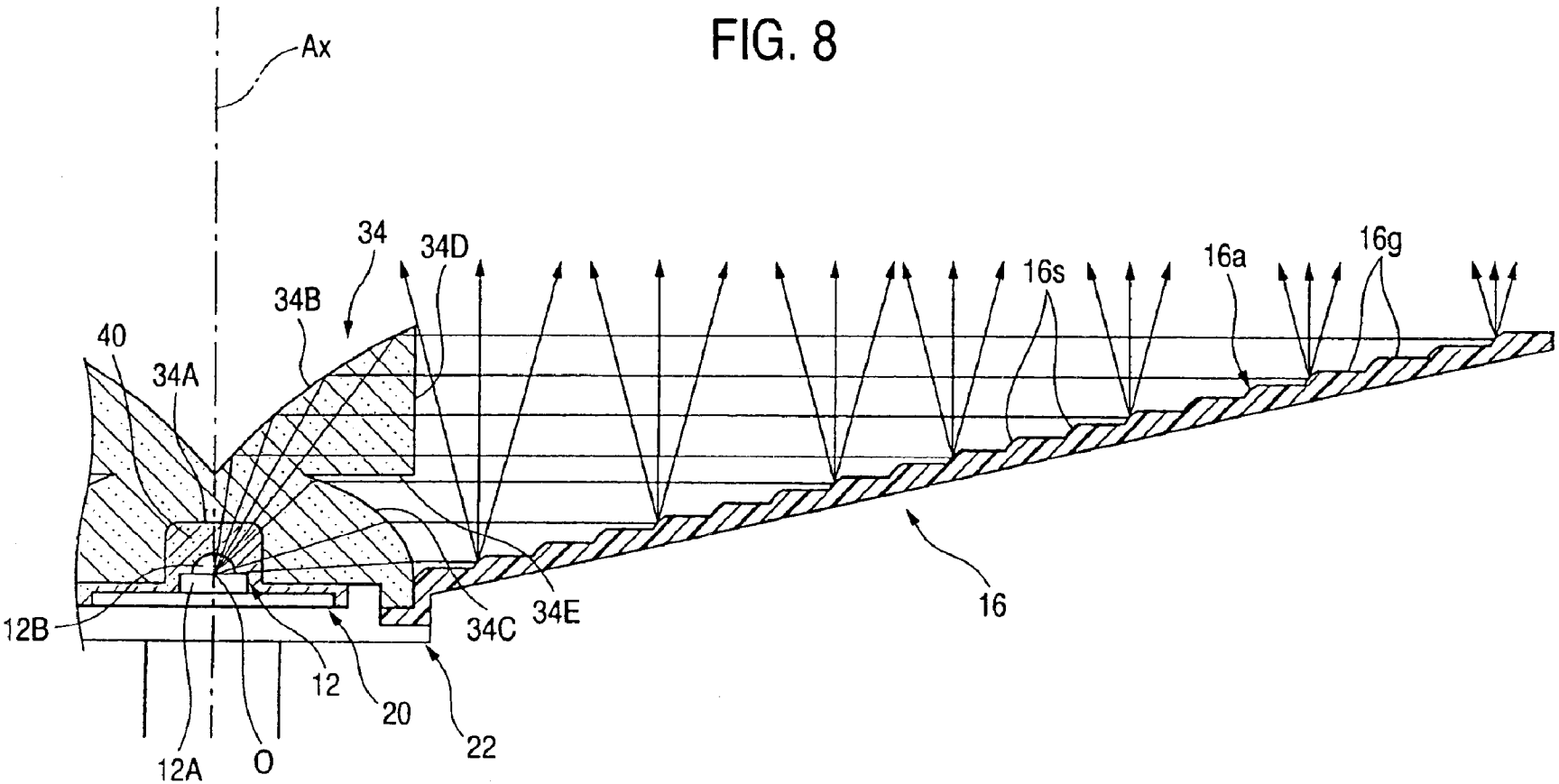
FIG. 8 is a view similar to FIG. 3 showing a translucent member in a fourth modification of the embodiment.

FIG. 8 is a view similar to FIG. 3 showing a translucent member 34 in the modification.

As shown in the figure, in the translucent member 34, a light-incidence recess 34A is configured in a manner different from the light-incidence recess 14A of the translucent member 14 in the FIG. 3 embodiment.

The light-incidence recess 34A of the translucent member 34 is formed into a bottomed cylindrical shape. A gap between the light-incidence recess 34A and the sealing resin 12B of the LED light source 12 is filled with a transparent filler 40. The filler 40 consists of a synthetic resin material which is approximately equal in refractive index to the translucent member 34. In the translucent member 34, the LED emitted light advances through the translucent member 34 straightly and radially from the luminescence center O via the filler 40.

The translucent member 34 comprises an internal reflection portion 34B, a refraction portion 34C, a cylindrical outer peripheral portion 34D, and an annular flat portion 34E which are strictly identical in shape with the corresponding portions of the translucent member 24 in the third modification.

Also when the configuration of the modification is employed, it is possible to attain the same functions and effects as those of the third modification.

In the modification, since the gap between the light-incidence recess 34A and the sealing resin 12B of the LED light source 12 is filled with the filler 40 which is approximately equal in refractive index to the translucent member 34, substantially no refraction occurs in the interface between the filler 40 and the translucent member 34. Therefore, the shape of the light-incidence recess 34A of the translucent member 34 can be arbitrarily set. Although the light-incidence recess 34A in the modification is set to have a simple shape or a bottomed cylindrical shape, it is a matter of course that the recess can be set to have another shape.

Next, a fifth modification of the embodiment will be described.

Figure 9:
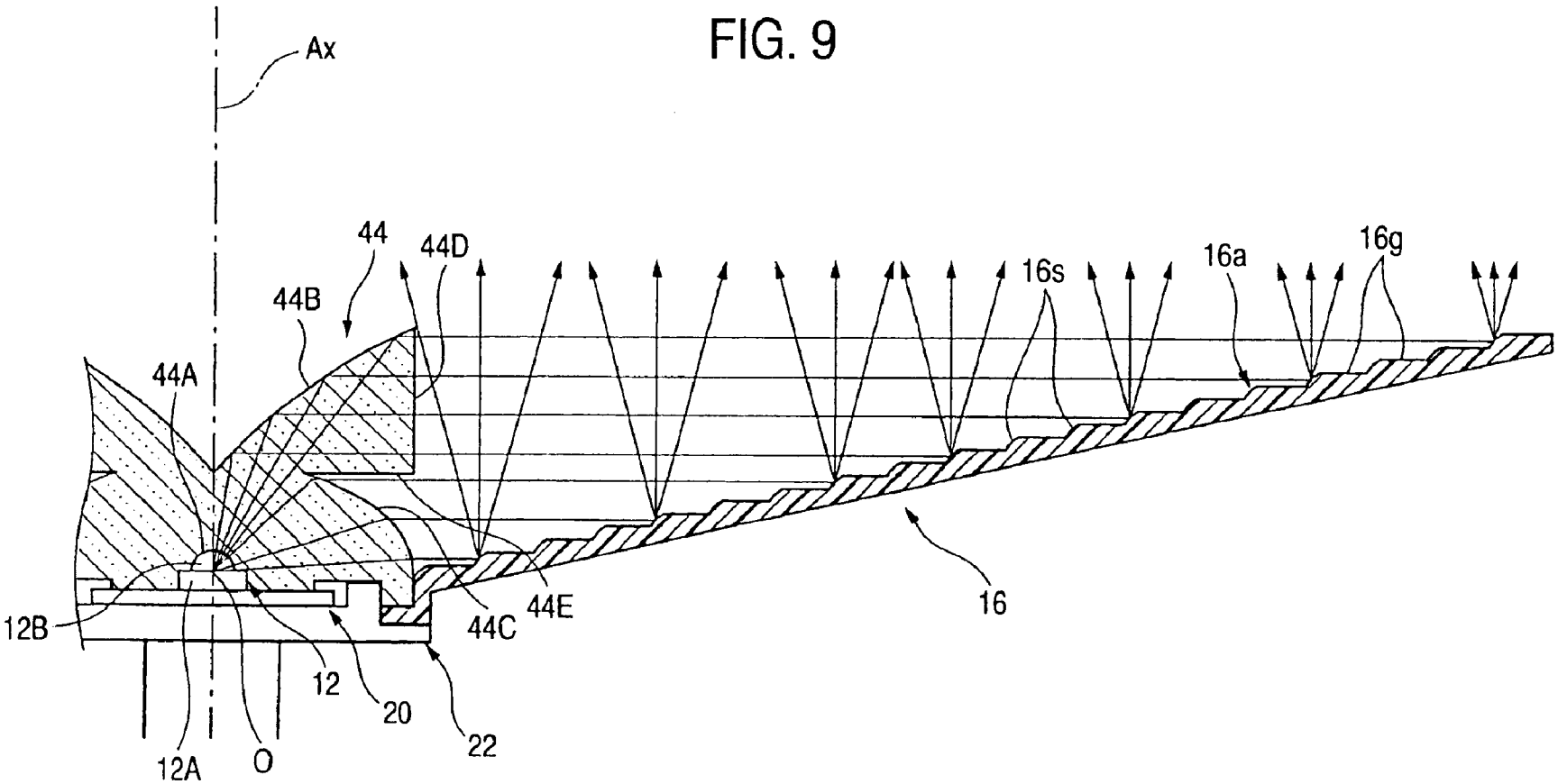
FIG. 9 is a view similar to FIG. 3 showing a translucent member in a fifth modification of the embodiment.

FIG. 9 is a view similar to FIG. 3 showing a translucent member 44 in the modification.

As shown in the figure, in the translucent member 44, a light-incidence recess 44A is configured in a manner different from the light-incidence recess 14A of the translucent member 14 in the FIG. 3 embodiment.

In the translucent member 44, the light-incidence recess 44A is formed so as to be in close contact with the sealing resin 12B of the LED light source 12. In the translucent member 44, the LED emitted light advances through the translucent member 44 straightly and radially from the luminescence center O of the LED light source 12.

The translucent member 44 comprises an internal reflection portion 44B, a refraction portion 44C, a cylindrical outer peripheral portion 44D, and an annular flat portion 44E which are strictly identical in shape with the corresponding portions of the translucent member 24 in the third modification.

Also when the configuration of the modification is employed, it is possible to attain the same functions and effects as those of the third modification.

In the modification, since the light-incidence recess 44A of the translucent member 44 is formed so as to be in close contact with the sealing resin 12B of the LED light source 12, the translucent member 44 can be easily formed by the insert molding process or the like, and the positional accuracy of the translucent member 44 can be enhanced.

Next, a sixth modification of the embodiment will be described.

Figure 10:
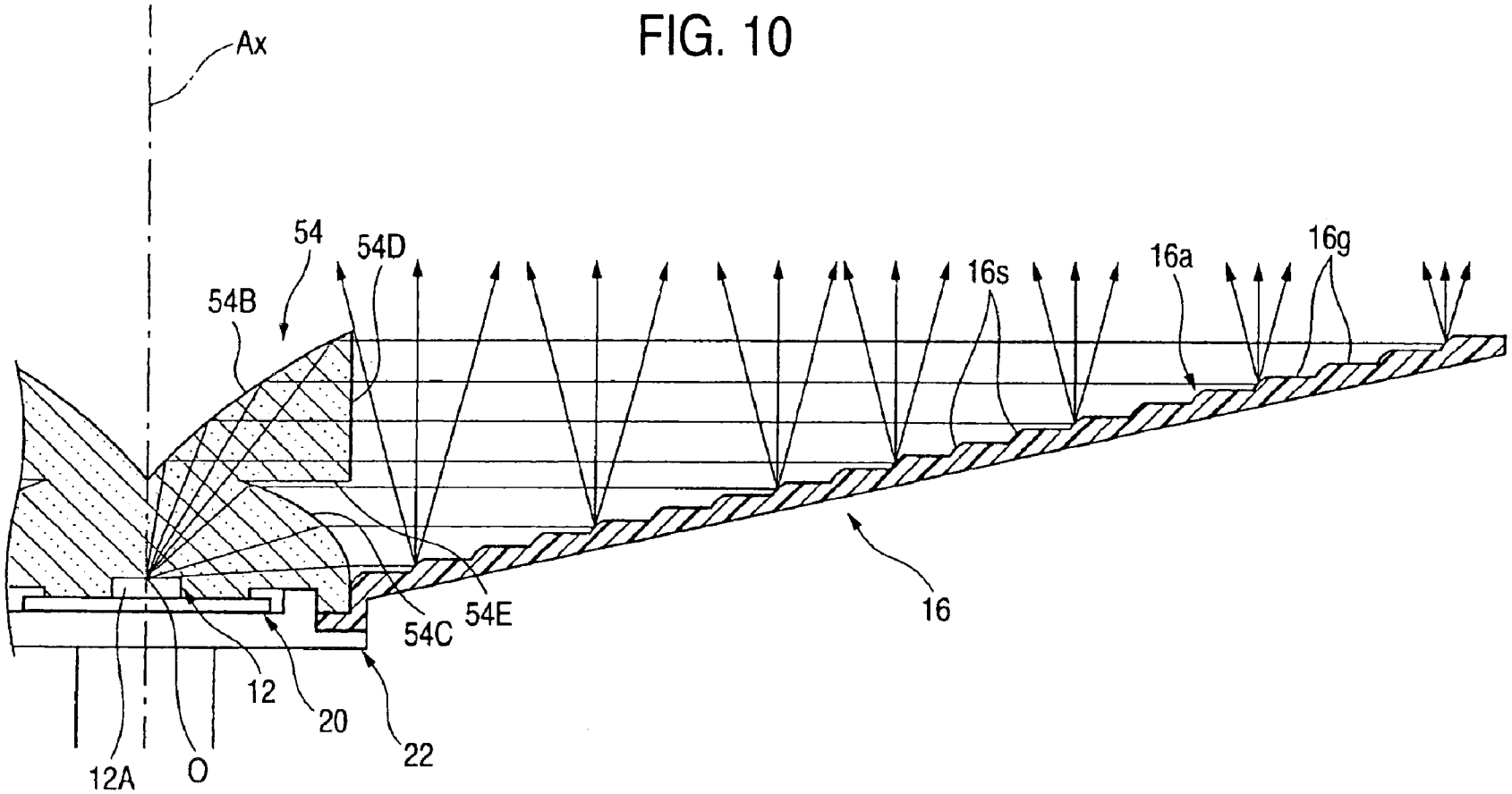
FIG. 10 is a view similar to FIG. 3 showing a translucent member in a sixth modification of the embodiment.

FIG. 10 is a view similar to FIG. 3 showing a translucent member 54 in the modification.

As shown in the figure, the translucent member 54 is formed so as to hermetically seal the LED main unit 12A of the LED light source 12, thereby enabling the member to exert also the function of the sealing resin 12B (see FIG. 3) of the LED light source 12. Unlike the translucent member 14 of the embodiment, the light-incidence recess 14A (see FIG. 3) is not formed in the translucent member 54. In the translucent member 54, the LED emitted light advances through the translucent member 54 straightly and radially from the luminescence center O of the LED light source 12.

The translucent member 54 comprises an internal reflection portion 54B, a refraction portion 54C, a cylindrical outer peripheral portion 54D, and an annular flat portion 54E which are strictly identical in shape with the corresponding portions of the translucent member 24 of the third modification.

Also when the configuration of the modification is employed, it is possible to attain the same functions and effects as those of the third modification.

In the modification, since the translucent member 54 is formed so as to hermetically seal the LED main unit 12A of the LED light source 12, the number of parts can be reduced, and the positional accuracy of the translucent member 54 can be enhanced.

Next, seventh and eighth modifications of the embodiment will be described.

Figure 11:
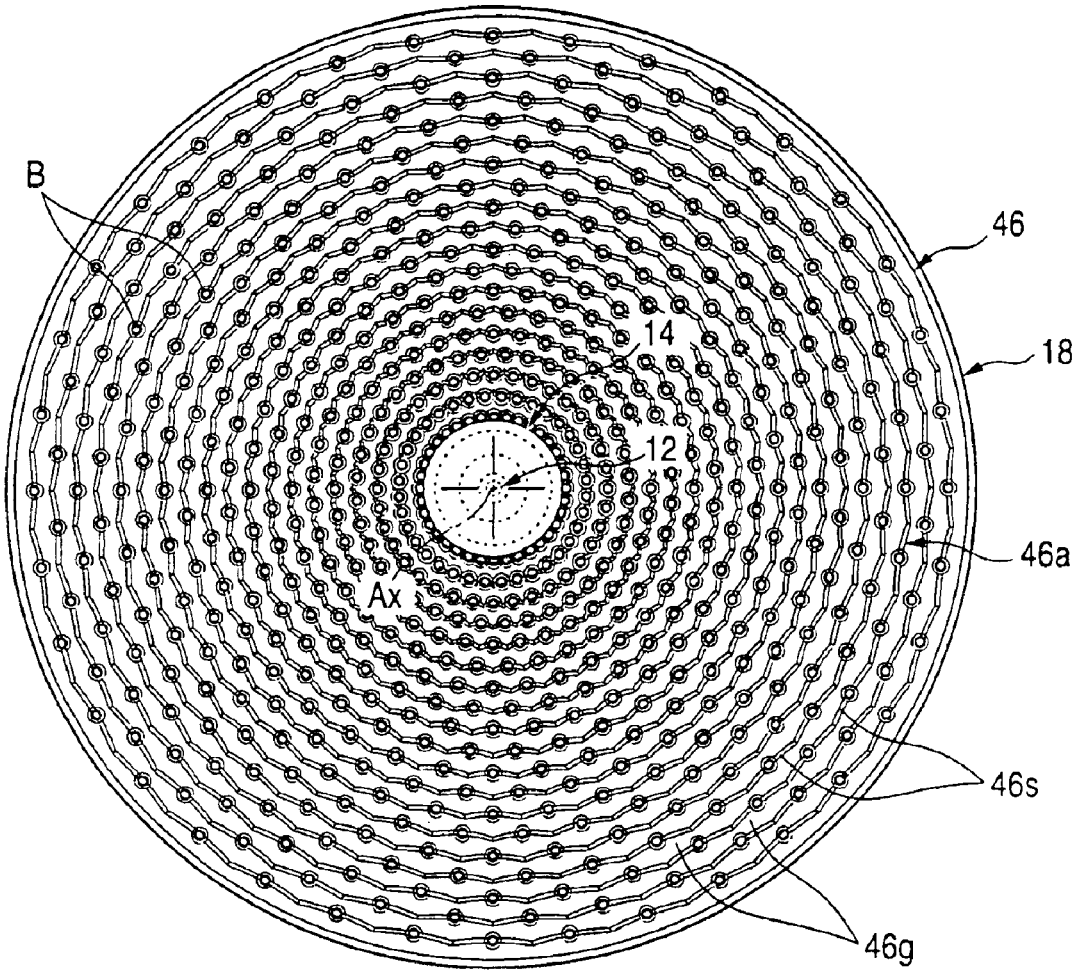
FIG. 11 is a view similar to FIG. 4 showing a reflector in a seventh modification of the embodiment.
Figure 12:
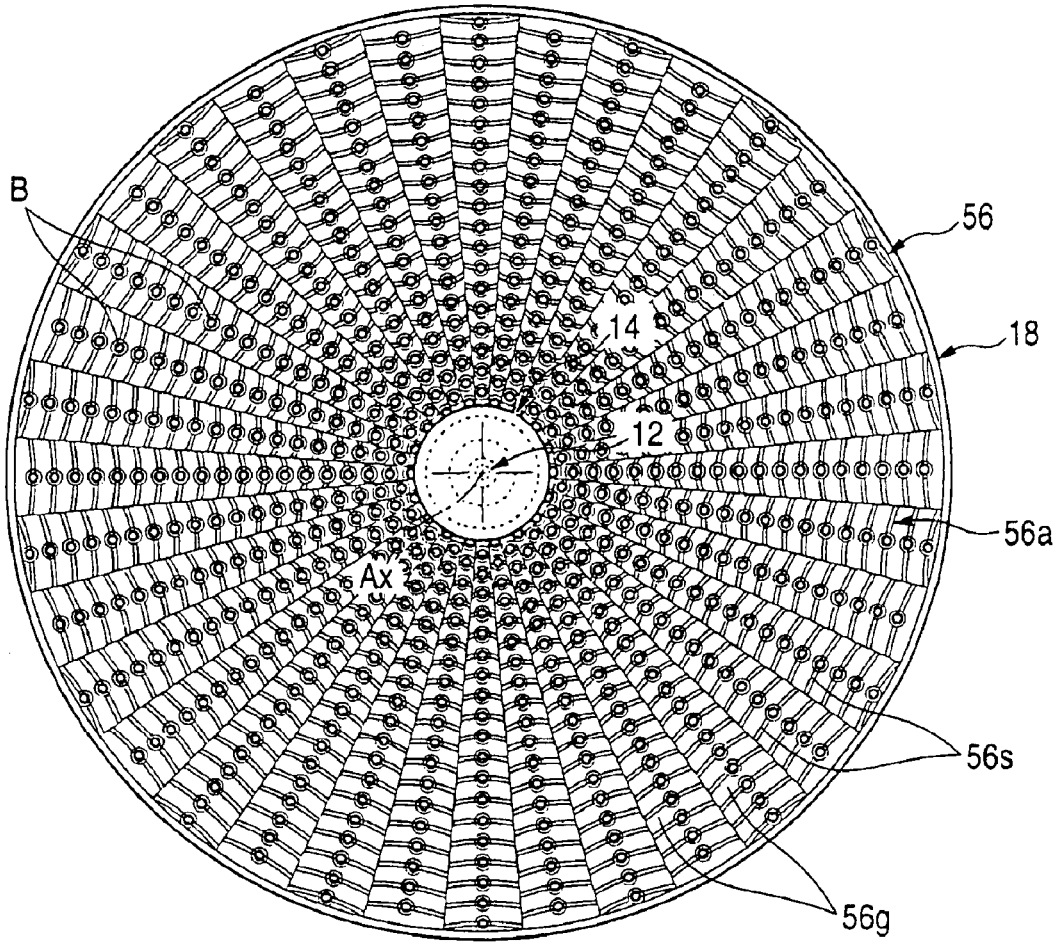
FIG. 12 is a view similar to FIG. 4 showing a reflector in an eighth modification of the embodiment.

FIGS. 11 and 12 are views similar to FIG. 4 showing respectively reflectors 46 and 56 in the modifications.

As shown in the figures, in the reflectors 46 and 56 in the modifications, plural reflective elements 46*s* and 56*s* formed on reflective surfaces 46*a* and 56*a* are arranged in a manner different from those of the reflector 16 in the embodiment.

In the reflectors 46 and 56, in the same manner as the reflector 16 in the embodiment, the reflective surfaces 46*a* and 56*a* are partitioned radially and concentrically, and the reflective elements 46*s* and 56*s*, and stepped portions 46*g* and 56*g* are allocated to the partitions. In the seventh modification, the positions of the reflective elements 46*s* are shifted from each other by a half pitch in a circumferential direction at every other pitch in a radial direction. By contrast, in the eighth modification, the positions of the reflective elements 56*s* are shifted from each other by a half pitch in a radial direction at every other pitch in a circumferential direction.

In the same manner as the reflective elements in the embodiment, the reflective elements 46*s* and 56*s* are formed into a convex curved surface which has a predetermined curvature in both radial and circumferential directions with respect to the optical axis Ax.

When the reflectors 46 and 56 are observed from the front side in a state where the LED light source 12 lights up, substantially center portions of the reflective elements 46*s* and 56*s* constituting the reflective surfaces 46*a* and 56*a* can be seen glaring as brilliant portions B. Since the reflective elements 46*s* and 56*s* are arranged in a manner different from those in the embodiment, the modifications can realize visual impressions different from the embodiment.

Next, a ninth modification of the embodiment will be described.

Figure 13:
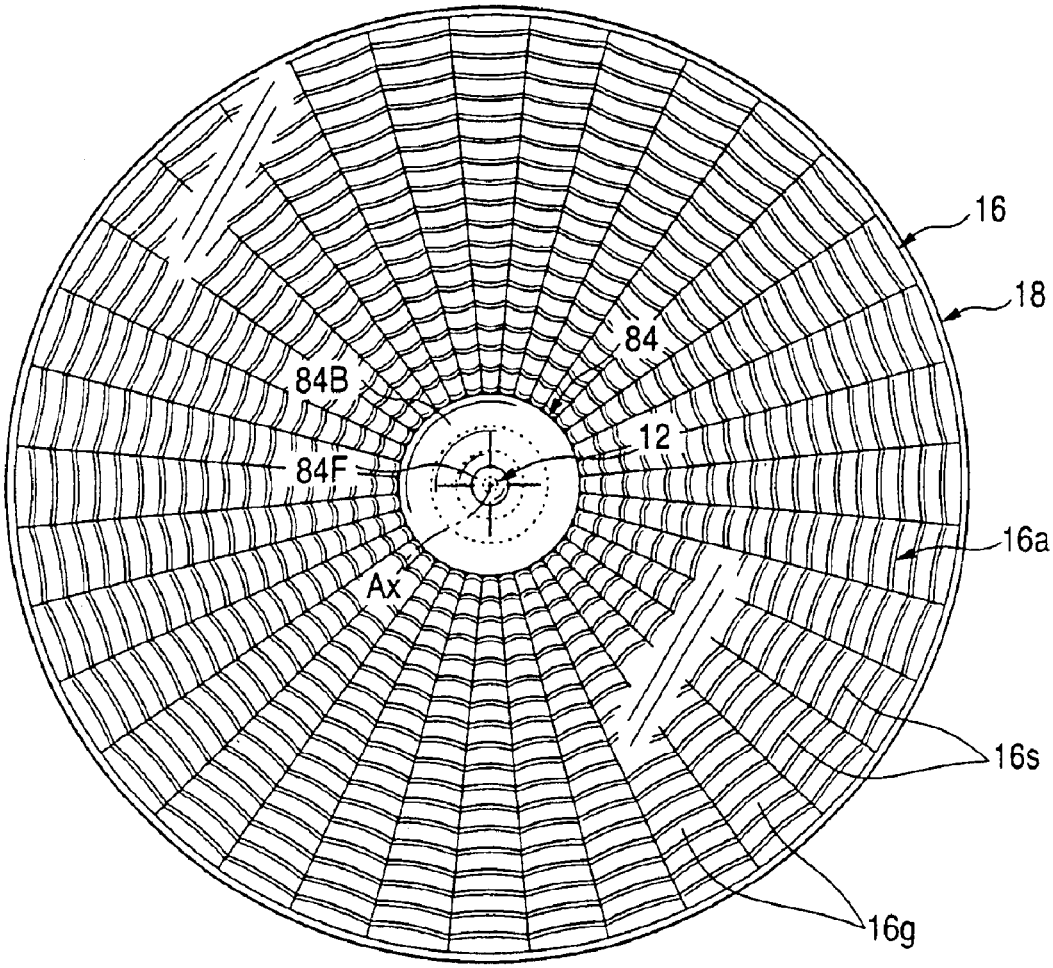
FIG. 13 is a view similar to FIG. 1 showing a translucent member in a ninth modification of the embodiment.
Figure 14:
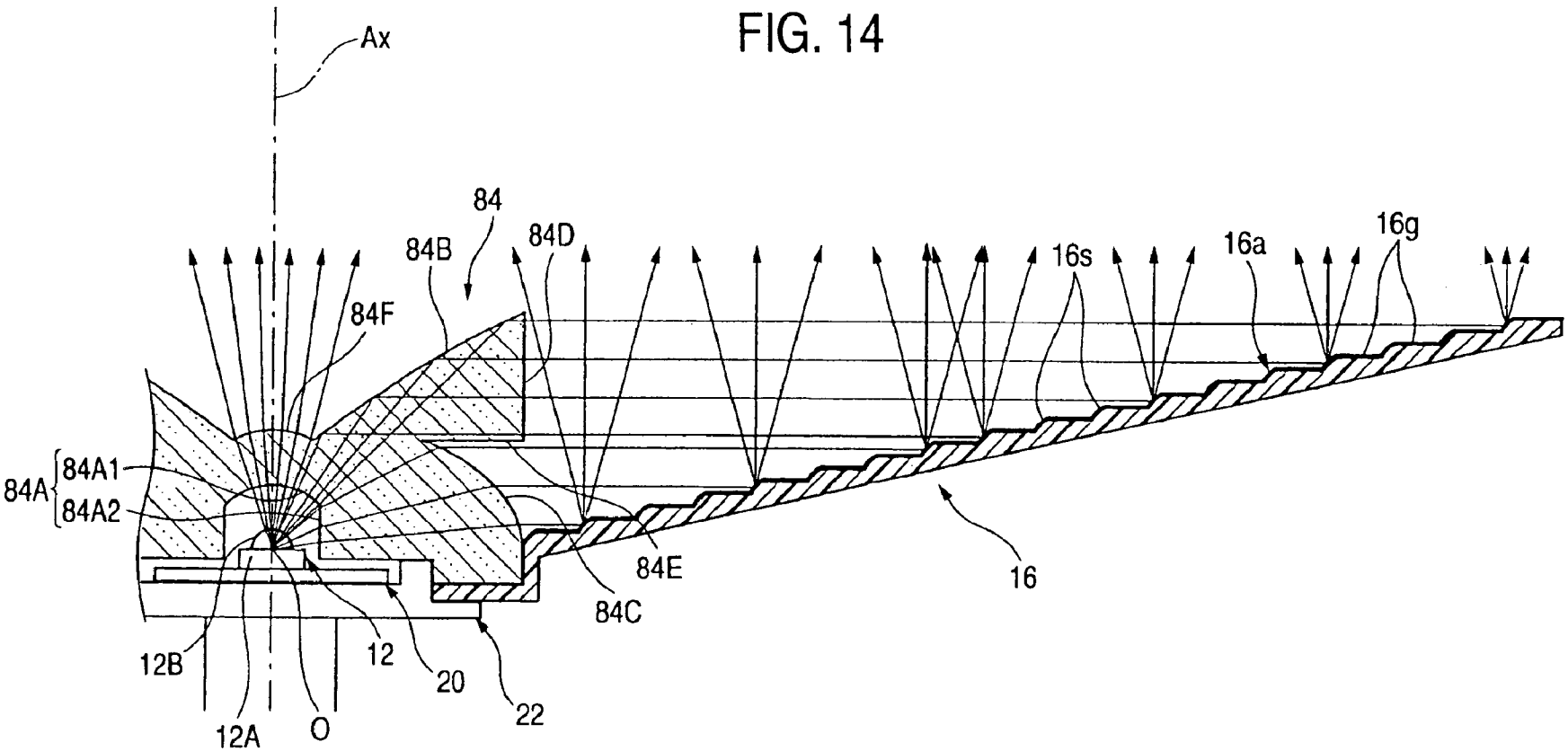
FIG. 14 is a view similar to FIG. 3 showing a translucent member in a ninth modification.

FIG. 13 and FIG. 14 show a translucent member 84 which is similar to the embodiment shown in FIG. 1 and FIG. 3.

However, this embodiment is distinguishable from the translucent member 14 shown in FIGS. 1 and 3 in that a direct irradiation portion 84F is formed on the translucent member 84.

The direct irradiation portion 84 is formed in a small radius region with its center axis being defined by a light axis Ax so that the incident light at the vicinity thereof, which is part of the light having small incident angle toward the direct irradiation portion 84, can be forwardly transmitted. As to the formation thereof, it is spherically formed of which curvature is set to be substantially the same as that of the spherical portion 84A1 of the light-incident recess 84A. Having such a translucent member 84, the LED emitted light as scattered incident light toward the direct irradiation portion 84F can be converged to the light axis side so as to be emitted in a certain diffusion angle. This diffusion angle might be set to be substantially the same as each reflective element 16S.

As the result of the direct portion 84F being formed, the size of the translucent member 84 might be larger as compared with that of other embodiment such as the translucent member 14. Also, some minor change might be made to the shapes of the internal reflection portion 84B and/or refraction portion 84C, by which their functionality can be kept in proper way such that emitted LED light can be incident to the reflective surface 16*a* of the reflector 16 substantially as parallel light. As for the light-incident recess 84A, and the cylindrical outer peripheral 84D and the annular flat portion 84E of the translucent member 84, their structures are substantially the same as other embodiments.

Figure 15:
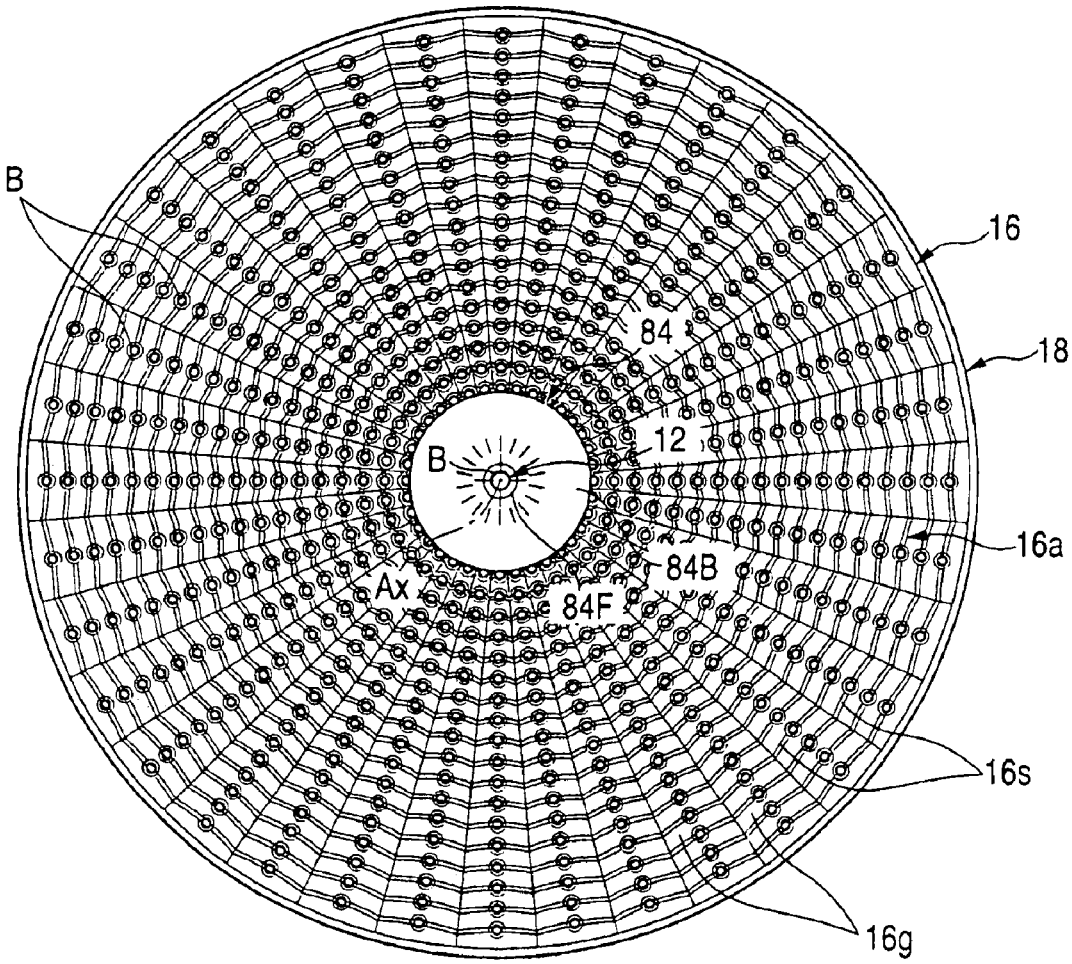
FIG. 15 is a view similar to FIG. 4 showing a translucent member in a ninth modification.

FIG. 15 shows the front view of the vehicle headlamp of this embodiment in the state of emitting the light source 12, which is provided with the translucent member 84.

As shown in the drawing, when observation is made to the vehicle headlamp from the front direction, not only the reflective surface 16*a* but also the direct irradiation portion 84F can be identified as brilliant part B. Further, the center portion of the direct irradiation part 84F as well as each center portion of each reflective element 16S can be simultaneously seen as scattering light points. The brilliant part B can be kept even in case of the observation point displaced a little from the center portions thereof in proportion to the mount of the displacement.

Next, a tenth modification of the embodiment will be described.

Figure 16:
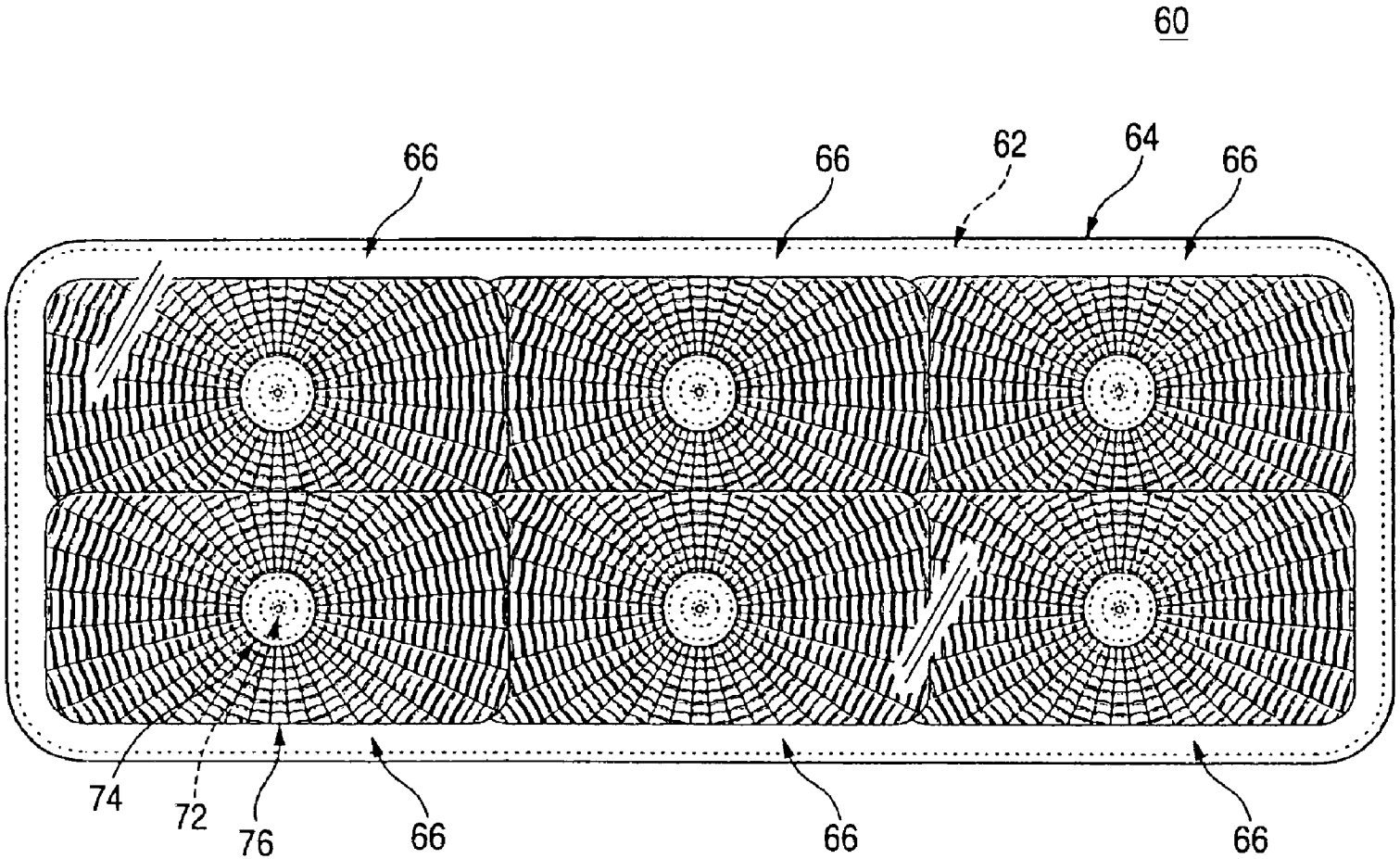
FIG. 16 is a front view of a vehicle lamp of a tenth modification of the embodiment.

FIG. 16 is a front view of a vehicle lamp 60 of the tenth modification.

In the vehicle lamp 60, plural (six) reflector units 66 are housed in a lamp housing configured by a lamp body 62 and a plain translucent cover 64.

Each of the reflector units 66 comprises an LED light source 72, a translucent member 74, and a reflector 76. The LED light source 72, the translucent member 74, and the reflector 76 are configured in the same manner as the LED light source 12, the translucent member 14, and the reflector 16 of the vehicle lamp 10 of the embodiment. However, the reflector 76 is set to have a laterally elongated rectangular external shape.

The reflector units 66 are arranged in two vertically juxtaposed horizontal rows so that outer peripheral edges of the reflectors 76 overlap with each other in the front view of the lamp.

When the configuration of the lamp of the modification is employed, it is possible to sufficiently ensure the brightness of the vehicle lamp 60.

The reflectors 76 of the reflector units 66 may have an external shape other than the laterally elongated rectangular shape which is shown in the figure. Therefore, the reflector units 66 can be freely arranged in accordance with the shape of the lamp, etc.

Above, the embodiment and modifications in which the vehicle lamp 10 or 60 is a tail lamp have been described. Also in a case of a vehicle lamp of another kind (for example, a stop lamp, a tail & stop lamp, a clearance lamp, or a turn signal lamp), when the lamp is configured in a manner similar to the embodiment and modifications, it is possible to attain the same functions and effects as those of the embodiment and modifications.

What is claimed is:

1. A vehicle lamp comprising: a light source which is placed to be directed toward a front of the lamp; a translucent member which is placed to receive light from the light source; and a reflector which is placed to reflect the light from the LED light source that is transmitted through the translucent member, toward the front of the lamp, wherein an internal reflection portion and a refraction portion are formed on a surface of the translucent member, the internal reflection portion internally reflecting small-angle incident light in a direction which is substantially perpendicular to an optical axis of the light source, the small-angle incident light being incident on the translucent member at a small angle with respect to the optical axis, the refraction portion refracting large-angle incident light in a direction which is substantially perpendicular to the optical axis, the large-angle incident light being incident on the translucent member at a large angle with respect to the optical axis; and wherein a reflective surface of the reflector is configured by a plurality of reflective elements which reflect the light from the light source that is transmitted through the translucent member, toward the front of the lamp, and the reflective elements are placed in a stepwise manner via stepped portions elongating in a direction which is substantially perpendicular to the optical axis.

2. The vehicle lamp according to claim 1, wherein the internal reflection portion is configured by a generally funnel-like curved surface of revolution about the optical axis, and the refraction portion is configured by a generally annular dome-like curved surface of revolution about the optical axis.

3. The vehicle lamp according to claim 1, wherein at least part of a reflective surface of the reflector is configured to reflect the light from said LED light source that is transmitted through the translucent member, toward the front of the lamp by internal reflection.

4. The vehicle lamp according to claim 1, wherein a direct irradiation portion by which said small-angle incident light being at the vicinity of the optical axis can be forwardly transmitted is provided on the translucent member.

5. The vehicle lamp according to claim 1, wherein the vehicle lamp further comprises a plurality of sets of the light source, the translucent member, and the reflector.

6. The vehicle lamp according to claim 1, wherein the light source is an LED light source.

7. The vehicle lamp according to claim 2, wherein at least part of a reflective surface of the reflector is configured to reflect the light from said LED light source that is transmitted through the translucent member, toward the front of the lamp by internal reflection.

8. The vehicle lamp according to claim 7, wherein a direct irradiation portion by which said small-angle incident light being at the vicinity of the optical axis can be forwardly transmitted is provided on the translucent member.

9. The vehicle lamp according to claim 8, wherein the vehicle lamp further comprises a plurality of sets of the light source, the translucent member, and the reflector.

10. The vehicle lamp according to claim 9, wherein the light source is an LED light source.

11. The vehicle lamp according to claim 2, wherein a direct irradiation portion by which said small-angle incident light being at the vicinity of the optical axis can be forwardly transmitted is provided on the translucent member.

12. The vehicle lamp according to claim 11, wherein the light source is an LED light source.

* * * * *